US006625566B1

(12) United States Patent
Peysson et al.

(10) Patent No.: US 6,625,566 B1
(45) Date of Patent: Sep. 23, 2003

(54) PRESSURE DROP CALCULATION METHOD AND SYSTEM TAKING ACCOUNT OF THERMAL EFFECTS

(75) Inventors: Yannick Peysson, Paris (FR); Isabelle King, Saint Cloud (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 308 days.

(21) Appl. No.: 09/721,674

(22) Filed: Nov. 27, 2000

(30) Foreign Application Priority Data

Dec. 7, 1999 (FR) ..... 99 15507

(51) Int. Cl.[7] ..... G04F 1/00; E21B 47/12; G01F 1/68

(52) U.S. Cl. ..... 702/176; 702/35; 702/50; 702/138; 73/152.02; 73/204.11; 73/806

(58) Field of Search ..... 702/176, 35, 50, 702/138; 73/806, 204.11, 152.02; 507/907; 175/65

(56) References Cited

U.S. PATENT DOCUMENTS 4,821,564 A 4/1989 Pearson et al. ..... 73/155

FOREIGN PATENT DOCUMENTS

FR 2723141 2/1996 ..... E21B/21/08
WO 9425732 11/1994 ..... E21B/47/00

OTHER PUBLICATIONS

Karstad, E. et al: "Temperature Model Provides Information for Well Control", Oil and Gas Journal, US, Penwell Publishing Col. Tulsa, vol. 96, No. 37, Sep. 14, 1998, pp. 76–80, 83–84, XP000833515, ISSN: 0030–1388.

Sas–Jaworsky A., et al.: "Predicting Friction Pressure Losses in Coiled Tubing Operations" World Oil, Gulf Publishing Co., Houston, vol. 218, No. 9, Sep. 1, 1997, pp. 141–144, 146, XP000723217, ISSN: 0043–8790.

*Primary Examiner*—John Barlow
*Assistant Examiner*—Meagan S. Walling
(74) *Attorney, Agent, or Firm*—Antonelli, Terry, Stout & Kraus, LLP

(57) ABSTRACT

The present invention relates to a method of calculating the pressure drops created by a given fluid in a circuit having a determined thermal profile. The method includes making up a database (BD) giving the rheology of various fluids at least according to the temperature; segmenting a thermal profile (2, 3) into sections (4, 5, 6, 7) and determining a representative temperature value (T1, T2, T3, T4) for the fluid in each section; using the database for determining the rheology of the fluid in each section at the representative temperature; and calculating and adding up the pressure drops in each section considering the rheology determined.

36 Claims, 3 Drawing Sheets

P ( m)
T (°C)
T1
T2
T3
T4
1
2
3
4
5
6
7
Rhéo1
Rhéo2
Rhéo3
Rhéo4

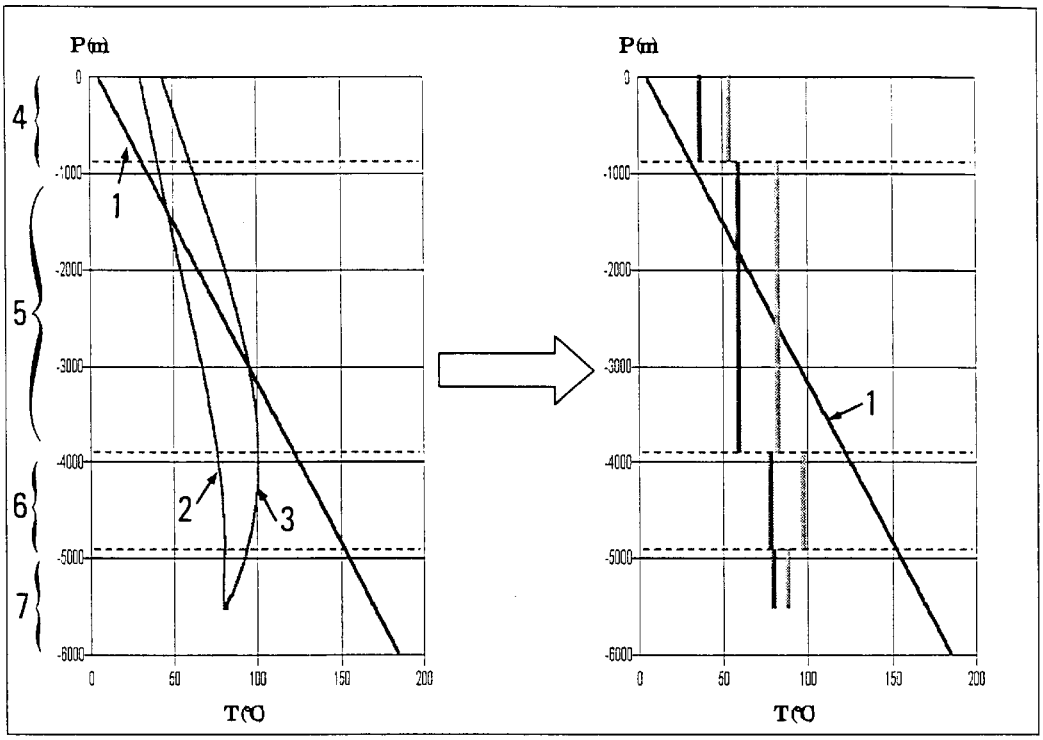
Figure 2a
Figure 2b
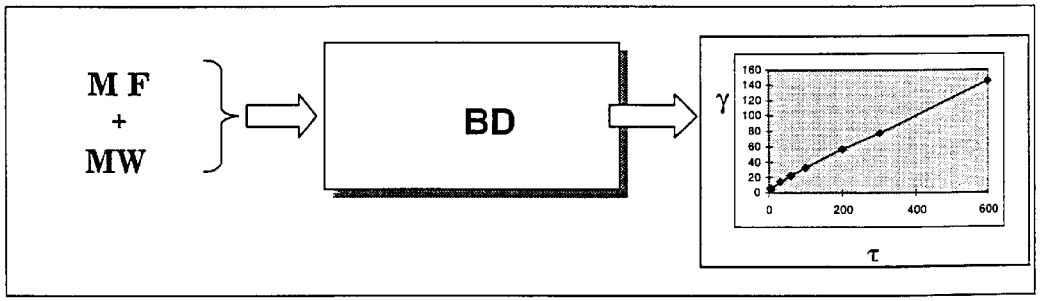
Figure 3

PRESSURE DROP CALCULATION METHOD AND SYSTEM TAKING ACCOUNT OF THERMAL EFFECTS

BACKGROUND OF THE INVENTION

1. Field of the Invention

The present invention relates to a method and to a system for calculating pressure drops in a circuit by taking account of the thermal effects along the circuit.

2. Description of the Prior Art

U.S. Pat. No. 5,850,621 describes a computer method allowing calculation of pressure drops in parts of a circuit such as a well drilled in the ground, the inner space of drillpipes or of tubes in the well, the annular space between these pipes or tubes and the well wall. Known pressure drop calculation methods account for the data relative to the well pattern, the characteristics of the circulating fluid and the flow conditions. In most calculation models, a rheology that is representative of the fluid is taken into account: Bingham, Ostwald or other models. Some models also account for the influence of the rotation of the pipes and/or of the eccentricity in the well. However, these calculation models do not account for the influence of the temperature variation and/or of the pressure variation on is the rheology of the fluid, a relatively important parameter for pressure drop calculation. Now, the temperature and pressure conditions in a wellbore, offshore or onshore, are excessively variable, which currently leads to miscalculations.

SUMMARY OF THE INVENTION

The present invention relates to a method of calculating pressure drops created by a fluid in a circuit having a determined thermal profile. The following steps are carried out:

- making up a database giving the rheology of various fluids at least according to the temperature;
- segmenting the thermal profile into sections and determining a temperature value representative of that of the fluid in the sections;
- using the database for determining the rheology of the fluid in each section at the representative temperature; and
- calculating and adding up the pressure drops in each section considering the determined rheology.

The thermal profile can be segmented for a substantially constant temperature range.

The mean temperature of the fluid in each section can be taken as the representative temperature.

The database can comprise the rheology of fluids according to the pressure.

The mean pressure of the fluid in each section can be taken into account for determining the rheology of the fluid in said section.

The database can be organized in fluid families.

The database can comprise laws relative to the rheology variation according to the temperature and/or the pressure for each fluid family.

The invention also relates to a system for calculating pressure drops in a circuit by implementing the method described above, the system comprising means for segmenting the thermal profile along the circuit; means for managing a database giving the rheology of various fluids according to the temperature and/or the pressure; and means for calculating pressure drops in each section.

The method is advantageously applied to calculation of pressure drops in a well in the process of being drilled.

The present method is implemented for accounting for the influence, notably, of thermal effects on the pressure drop through the rheology of the fluid. The evolution of the temperature and of the pressure in the well locally modifies the viscosity of the mud and therefore the generated pressure drops. The precision of interpretation of the value and of the variations of the discharge pressure measured at the surface is greatly improved.

BRIEF DESCRIPTION OF THE DRAWINGS

Other features and advantages of the present invention will be clear from reading the description hereafter of non limitative examples, with reference to the accompanying drawings wherein:

FIGS. 2*a* and 2*b* show more precisely the segmenting procedure;

FIG. 3 diagrammatically shows coupling with a database;

DETAILED DESCRIPTION OF THE PREFERRED EMBODIMENTS

Figures 1A, 1B, 1C:
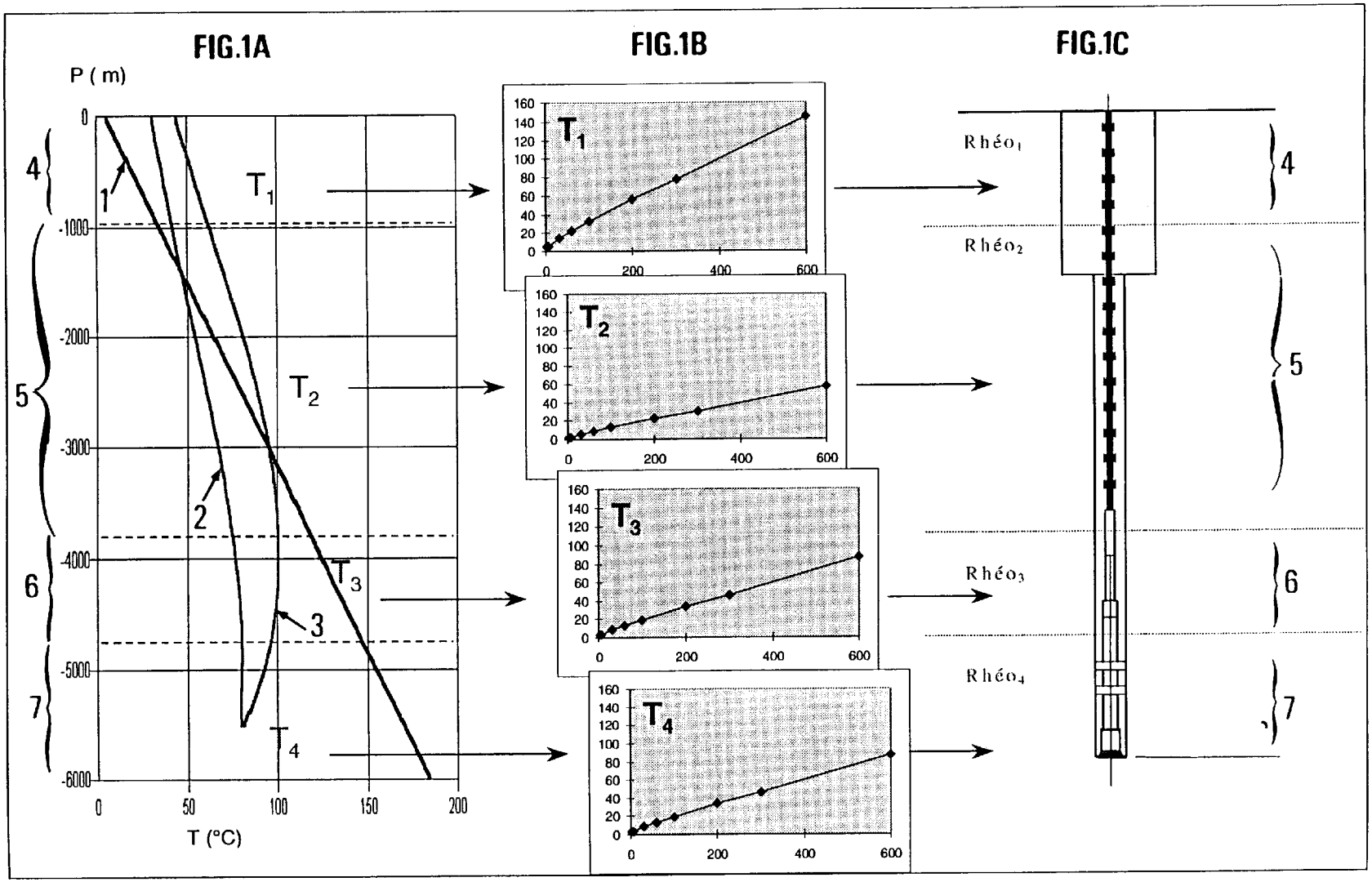
FIGS. 1A, 1B and 1C illustrate the principle of the present invention.

The representations of FIGS. 1A, B and C sum up the principle of the method. FIG. 1A gives the profile of the temperature (T in ° C.) as a function of the depth (P in meters). Curve 1 gives the geostatic temperature. From this local datum and from the thermal exchange parameters in the well (λ steel, formation, fluid; fluid flow rate; geometry, etc.), the profile of the temperature within the pipes (curve 2) and outside (curve 3) is determined by means of a thermal model. The WELLCAT (registered trademark) software marketed by the ENERTECH company (USA) can for example be mentioned here, which allows determination of this type of thermal profile in a well in the process of being drilled. The thermal profile is here segmented into sections 4, 5, 6, 7 according to the depth. Four sections whose representative temperatures are respectively T1, T2, T3 and T4 are shown here.

FIG. 1B symbolically shows a database relative to the rheology of the fluid circulating in the well. A rheogram that is included in the base is associated with each temperature T1, T2, T3 and T4.

FIG. 1C diagrammatically shows the cross-section of the well and the various circuit sections 4, 5, 6 and 7 to which the determined rheograms correspond.

FIGS. 2*a* and 2*b* describe more precisely the method for segmenting the thermal profile. FIG. 2*a* is similar to the representation of FIG. 1A and it shows the segmentation in four sections 4–7 for which the mean temperature of each section has been selected as the representative temperature for the section considered. FIG. 2*a* is transformed into the representation of FIG. 2*b* where, in each section, the temperature is considered to be constant and equal to the mean temperature in this part.

Division into sections can be done automatically. It preferably is an even division as for the temperature but not for the length. The thermal profile can be segmented every 3° C. for example, or more precisely, every 0.5° C. Thus, the temperature amplitude is the same in each section. The user can select the segmentation interval according to circumstances.

The temperature and the pressure in each section allows determination of the corresponding rheology by means of the mud database. By first approximation, the mean hydrostatic pressure can be selected for each section determined by the temperature range selected. The effect of the temperature is generally preponderant in relation to the pressure concerning the rheology variation of the drilling fluid.

The pressure drop is then calculated for each section, with the rheology determined for each section, prior to being summed up in order to obtain the total pressure drop in the circuit.

FIG. 3 diagrammatically shows the calculation and the determination of the rheology with database BD. The database has been made up from families of drilling fluids (ME) used in the field. It comprises water-base muds and oil-base muds. Experimental measurements were carried out for temperatures ranging between 20° C. and 170° C., pressure variations up to 400 bars and variable mud weights (MW). A rheometer Fann 70 (HP-HT) is conventionally used for the measurements allowing the rheograms to be drawn.

From knowledge of the fluid family to which the considered drilling fluid (ME) belongs and of the mud weight (MW), the corresponding existing rheological data arc stored in base BD. It is possible to determine laws giving the rheology variation per fluid family or subfamily according to the mud weight, pressure or temperature parameter. The existence of such laws simplifies calculations in the pressure drop calculation module.

The pressure drops can thus be calculated by means of a fluid rheology that is close to reality. Calculation can be refined by means of the pressure value. In fact, if a simplified pressure value has been initially taken, for example the mean hydrostatic pressure of the section, the calculation model can recalculate the mean pressure more precisely by taking into account the static and dynamic pressure, which is taken into account for searching in the database.

It is clear that segmentation of the thermal profile as described above can be done independently between the inner circuit and the annular circuit. The invention is not limited to a division into identical sections of equal depth for the inner pipe circuit and the annular circuit.

EXAMPLE

Figure 4:
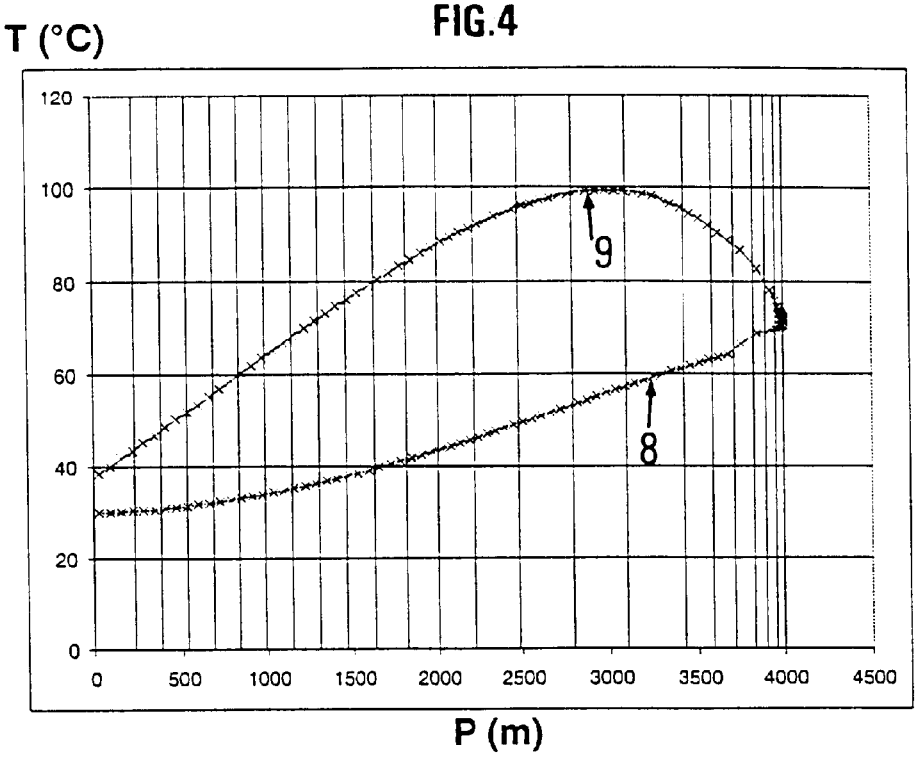
FIG. 4 shows an example of a thermal profile in an onshore well used for dealing with an example.

A 4000-m deep onshore test well is simulated in a thermal calculation software allowing obtaining of the temperature profile after a half-hour's drilling, from the equilibrium of the temperature of the fluid with the temperature of the formation. FIG. 4 gives this temperature profile T in ° C. as a function of the depth in meters (abscissa). Curve 8 gives the temperature of the fluid in the pipes as a function of the depth. Curve 9 gives the temperature of the fluid in the annulus.

The circuit is:

a hole cased with a 13" ⅜ casing (inside diameter: 323 mm), 3000 m long, a hole 12.25 inches (311.15 mm) in diameter, 1000 meters long, 5" Grade G pipes, 3820 m long, 8" drill collars (OD=203.2 mm; ID=72 mm), 180 m long.

If the sum of the pressure drops Δp is calculated without taking account of the thermal effects (i.e. at a constant temperature equal to the surface temperature), in the case of a water-base mud and of an oil-base mud, the following results are obtained:

Bentonite water-base mud F1:Δp=133.5 bars

Oil-base mud O1:Δp=223.5 bars.

Considering the thermal profile segmented into 23 sections with a 4° C. amplitude (it has been checked that the results are identical after 23 sections) and the use of the database relative to the rheology for the temperature and the pressure (mean hydrostatic pressure in the section considered), the results are as follows:

Bentonite water-base mud F1:Δp=128.7 bars (difference: 4.8 bars≈4%)

Oil-base mud O1:Δp=195.8 bars (difference: 27.7 bars≈12%).

Figure 5:
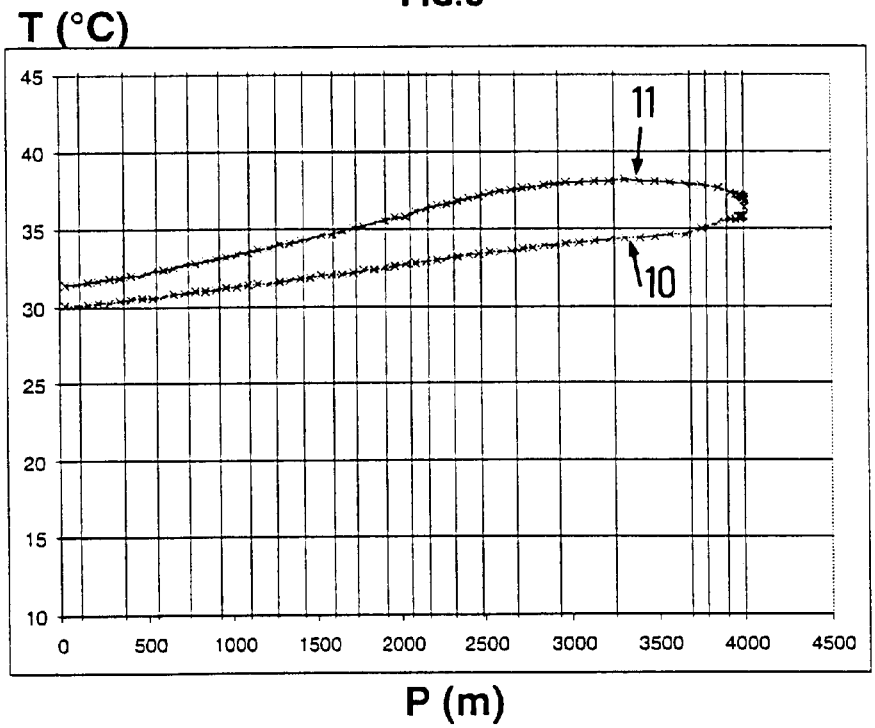
FIG. 5 shows an example of a thermal profile in an offshore well.

A 4000-m deep offshore test well is simulated in a thermal calculation software allowing obtaining of the temperature profile after 5 hours' drilling, from the equilibrium of the temperature of the fluid with the temperature of the formation. FIG. 5 gives this temperature profile T in ° C. as a function of the depth in meters (abscissa). Curves 10 and 11 give the temperature of the fluid as a function of the depth respectively inside the pipes and in the annulus. The effect of the cooling of the drilling riser through a 2000-m water depth is very noticeable. The circuit given in this example is exactly the same as the circuit of the previous example, except that there is a 2000-m water depth, the borehole being then only 2000 m long.

Considering the thermal profile segmented into 23 sections with a 0.5° C. amplitude, the results obtained are as follows:

Bentonite water-base mud F1:Δp=131.3 bars (difference: 2.2 bars≈1.5%)

Oil-base mud O1:Δp=216.2 bars (difference: 7.3 bars≈3.5%).

The differences are lesser in this example because the temperature variation is much lower.

These examples show that the thermal and pressure effects that modify the rheology of the circulating fluid correspond in some critical cases to about 5 to 10% of the sum of the pressure drops. The present invention notably improves the calculation precision, which can admit of relevant comparisons between the calculated value and the measured value of the discharge pressure.

What is claimed is:

1. A method of calculating pressure drops created by a fluid in a circuit having a determined thermal profile, comprising:

providing a database containing a rheology of fluids at least according to the temperature;

segmenting the thermal profile into sections and determining a temperature value representative of the fluid in the sections;

using the database for determining a rheology of the fluid in each section at the temperature value representative of the fluid in each section; and calculating the pressure drop in each section and adding up the calculated pressure drop in each section by utilizing the determined rheology in each section.

2. A method as claimed in claim 1, wherein:

the thermal profile is segmented for a substantially constant temperature range.

3. A method as claimed in claim 2, wherein:

a mean temperature of the fluid in each section is taken as the representative temperature.

4. A method as claimed in claim 3, wherein:

the database comprises the rheology of fluids according to pressure.

5. A method as claimed in claim 4, wherein:

a mean pressure of the fluid in each section is taken into account for determining the rheology of the fluid in the section.

6. A method as claimed in claim 2, wherein:

the database comprises the rheology of fluids according to pressure.

7. A method as claimed in claim 6, wherein:

a mean pressure of the fluid in each section is taken into account for determining the rheology of the fluid in the section.

8. A method as claimed in claim 2, wherein:

the database is organized into fluid families.

9. A method as claimed in claim 8, wherein:

the database comprises laws relative to a variation of rheology according to at least one of temperature and pressure for each fluid family.

10. A system for calculating pressure drops in a circuit, comprising:

means for segmenting a thermal profile along the circuit;

means for managing a database giving a rheology of fluids according to at least one of temperature and pressure of the fluids; and means for calculating the pressure drop in each section, which implements a method as claimed in claim 2.

11. An application of a method as claimed in claim 2 for calculation of pressure drop in a well which is being drilled.

12. A method as claimed in claim 1, wherein:

a mean temperature of the fluid in each section is taken as the representative temperature.

13. A method as claimed in claim 12, wherein:

the database comprises the rheology of fluids according to pressure.

14. A method as claimed in claim 13, wherein:

a mean pressure of the fluid in each section is taken into account for determining the rheology of the fluid in the section.

15. A method as claimed in claim 12, wherein:

the database is organized into fluid families.

16. A method as claimed in claim 15, wherein:

the database comprises laws relative to a variation of rheology according to at least one of temperature and pressure for each fluid family.

17. A system for calculating pressure drops in a circuit, comprising:

means for segmenting a thermal profile along the circuit;

means for managing a database giving a rheology of fluids according to at least one of temperature and pressure of the fluids; and means for calculating the pressure drop in each section, which implements a method as claimed in claim 12.

18. An application of a method as claimed in claim 12 for calculation of pressure drop in a well which is being drilled.

19. A method as claimed in claim 1, wherein:

the database comprises the rheology of fluids according to pressure.

20. A method as claimed in claim 19, wherein:

a mean pressure of the fluid in each section is taken into account for determining the rheology of the fluid in the section.

21. A method as claimed in claim 20, wherein:

the database is organized into fluid families.

22. A method as claimed in claim 21, wherein:

the database comprises laws relative to a variation of rheology according to a temperature and/or to a pressure for each fluid family.

23. A system for calculating pressure drops in a circuit, comprising:

means for segmenting a thermal profile along the circuit;

means for managing a database giving a rheology of fluids according to at least one of temperature and pressure of the fluids; and means for calculating the pressure drop in each section, which implements a method as claimed in claim 20.

24. An application of a method as claimed in claim 20 for calculation of pressure drops in a well which is being drilled.

25. A method as claimed in claim 19, wherein:

the database is organized into fluid families.

26. A method as claimed in claim 25, wherein:

the database comprises laws relative to a variation of rheology according to at least one of temperature and pressure for each fluid family.

27. A system for calculating pressure drops in a circuit, comprising:

means for segmenting a thermal profile along the circuit;

means for managing a database giving a rheology of fluids according to at least one of temperature and pressure of the fluids; and means for calculating the pressure drop in each section, which implements a method as claimed in claim 19.

28. An application of a method as claimed in claim 19 for calculation of pressure drop in a well which is being drilled.

29. A method as claimed in claim 1, wherein:

the database is organized into fluid families.

30. A method as claimed in claim 29, wherein:

the database comprises laws relative to a variation of rheology according to at least one of temperature and pressure for each fluid family.

31. A system for calculating pressure drops in a circuit, comprising:

means for segmenting a thermal profile along the circuit;

means for managing a database giving a rheology of fluids according to at least one of temperature and pressure of the fluids; and means for calculating the pressure drop in each section, which implements a method as claimed in claim 30.

32. An application of a method as claimed in claim 30 for calculation of pressure drop in a well which is being drilled.

33. A system for calculating pressure drops in a circuit, comprising:

means for segmenting a thermal profile along the circuit;

means for managing a database giving a rheology of fluids according to at least one of temperature and pressure of the fluids; and means for calculating the pressure drop in each section, which implements a method as claimed in claim 29.

34. An application of a method as claimed in claim 29 or calculation of pressure drop in a well which is being drilled.

35. A system for calculating pressure drops in a circuit, comprising:

means for segmenting a thermal profile along the circuit;

means for managing a database giving a rheology of fluids according to at least one of temperature and pressure of the fluids; and means for calculating the pressure drop in each section, which implements a method as claimed in claim 1.

36. An application of a method as claimed in claim 1 for calculation of pressure drop in a well which is being drilled.

* * * * *